United States Patent [19]

Saxby

[11] Patent Number: 4,942,818

[45] Date of Patent: Jul. 24, 1990

[54] TRAINING OR MARKING BULLETS

[75] Inventor: Michael E. Saxby, Leamington Spa, England

[73] Assignee: Comte De Lalaing (formerly Josse Ghislain Emmanuel De Lalaing), Zandbergen, Belgium

[21] Appl. No.: 264,691

[22] Filed: Oct. 31, 1988

[30] Foreign Application Priority Data

Oct. 31, 1987 [GB] United Kingdom ..... 8725589

[51] Int. Cl.[5] ..... F42B 8/12

[52] U.S. Cl. ..... 102/444; 102/502; 102/513; 102/515

[58] Field of Search ..... 102/444, 395, 498, 501, 102/502, 511, 513, 515; 273/58 R, 428

[56] References Cited

U.S. PATENT DOCUMENTS

| | | | |
|---|---|---|---|
| 1,953,904 | 4/1934 | Boyer et al. | 102/511 |
| 2,292,047 | 8/1942 | Calhoun | 102/511 |
| 3,031,966 | 5/1962 | Metzger | 102/513 |

FOREIGN PATENT DOCUMENTS

| | | | |
|---|---|---|---|
| 25288 | 6/1987 | Austria . | |
| 60933 | 3/1891 | Fed. Rep. of Germany . | |
| 190581 | 2/1906 | Fed. Rep. of Germany . | |
| 1215028 | 4/1966 | Fed. Rep. of Germany . | |
| 535108 | 3/1941 | United Kingdom | 102/442 |
| 1077027 | 7/1967 | United Kingdom . | |
| 1091551 | 11/1967 | United Kingdom | 102/529 |
| 1103467 | 2/1968 | United Kingdom . | |
| 1175274 | 12/1969 | United Kingdom | 102/529 |
| 1542538 | 3/1979 | United Kingdom . | |
| 2149067 | 6/1985 | United Kingdom . | |
| 2163534 | 2/1986 | United Kingdom . | |

*Primary Examiner*—Charles T. Jordan
*Assistant Examiner*—Michael J. Carone
*Attorney, Agent, or Firm*—Neil F. Markva

[57] ABSTRACT

A bullet primarily composed of a filler powder embedded in a wax-based matrix, the powder comprising metal particles; the bullet being designed to disrupt upon impact.

10 Claims, 1 Drawing Sheet

TRAINING OR MARKING BULLETS

FIELD OF THE INVENTION

This invention concerns bullets, pellets and like missiles hereinafter generally referred to as "bullets", and cartridge incorporating such bullets, for use in small-arms training and for marking a target.

BACKGROUND OF THE INVENTION

Using live explosive-propellant ammunition for firearms training has well known disadvantages. Alternative forms of compressed gas powered ammunition are available to reduce some of these disadvantages. However, realistic practice with any small arm requires the ammunition to provide sufficient energy to propel the bullets at a velocity sufficient to achieve reasonable accuracy. At such velocities metal bullets can be lethal. To reduce such dangers, plastics bullets have been proposed, but such bullets leave unwanted residues in the weapon barrel, are inaccurate in flight, and are still very dangerous.

Other forms of bullets are known, for combat games, which comprise a shell or casing of hard gelatin filled with paint, but such bullets are inaccurate in flight, have limited range and the casing can gash the skin of a target person.

The task of the invention is to provide a bullet which is stable in flight, does not damage the weapon barrel, and reduces the risks of lethal accident.

According to the present invention there is provided a bullet partially composed of metal, and characterized in that the metal is in the form of a powder embedded in a solid wax-based or wax-like matrix.

The matrix is preferably formulated to disrupt firstly upon impact with a target and secondly upon being exposed to excessive propulsion forces, so that impact damage is limited by disruption of the bullet.

Such bullets are reasonably safe for use in "war-games", "combat-games", and like operations in which the targets are persons, and the bullets are preferably used in ammunition and/or weapons which limit the muzzle energy to a maximum of about 3.5 foot/pounds (or about 0.5 kilogram meters) and preferably to less than about 2.5 foot/pounds (or about 0.35 kilogram meters) to avoid the need for such persons to wear special protective clothing. Such muzzle energy is obtained in accordance with known techniques.

The bullet may contain coloring to act as a marker upon striking a target. The coloring may either be easily removable by ordinary laundering or dry-cleaning processes; or be of an indelible or "permanent" kind which is extremely difficult to remove especially from clothing.

Such marker bullets are useful for marking selected persons, e.g. to identify a particular person in a riot or civil-disturbance.

The metal is preferably a dense metal or alloy, such as brass, copper, lead or zinc, or a mixture thereof, reduced to a powder in which the particles are less than 400 microns. The particles preferably provide at least 70% of the mass of the bullet.

The matrix preferably comprises a solid material such as paraffin wax, microcrystalline wax, polyethylene wax, carnauba wax, candelilla wax, bees wax, a wax-like hydrocarbon preparation or a wax-like silicone preparation or a blend thereof; and said solid material is preferably blended with an oily or fatty material which serves as a plasticizer to make the matrix sufficiently tractable to permit expansion of the bullet, upon firing, to engage the barrel rifling, and also to improve the behavior of the bullet upon impact with the target.

The melting or softening temperature of the solid material and the proportion of oily or fatty material may be determined to suit the ambient temperature-range of the conditions under which the bullet is intended to be used, so that at the bottom of said range the bullet does not become so brittle that it shatters upon firing while at the top of said range the bullet remains sufficiently hard to be fired without melting or becoming plastically deformed to an unacceptable degree.

The proportions of the solid material to oily or fatty material may be varied from 1:4 for cold climates to 9:1 for hot climates For example, the percentage of solid material preferably lies between 20% and 40% for polar climates, between 40% and 70% for temperate climates, and between 60% and 90% for tropical climates, the remainder being substantially the oily or fatty material and optionally a small amount of dye and/or other additive.

The density of the bullet is primarily determined by the proportion of metal, or metal and pigment powdered mixture, in the bullet. Satisfactory results can be obtained with blends in which the weight of the matrix is roughly the same as the weight of powder, provided that the matrix is formulated to suit the climatic conditions of use; but it has been found that the operational temperature range and other properties can be improved by using a relatively fine powder, preferably such as one in which most particles are less than 200 microns, e.g. 70/150 microns, and a relatively high proportion of the powder, such as 75% or more, so that a single formulation can be employed under most climatic conditions without giving rise to firing problems or, more importantly, increasing the risk of impact damage upon the target.

The matrix formulation problems posed under certain conditions (e.g. the need to compromise between the hardness required during handling, firing and flight of the bullet and the softness required for reducing the risk of damaging the target, when the latter is a live creature or person to be marked) are reduced in accordance with a preferred feature of the invention by formulating the matrix to meet the softness requirements and coating a part or all of the bullet with a harder formulation of wax-based material to provide superficial strength. Such a coating preferably has an average thickness less than 1 mm, the preferred thickness range being less than 0.5 mm e.g. between 0.2 and 0.02 mm.

The bullet preferably has a weight of less than 3 grams, e.g. about 1.5 to 2.4 grams.

The bullets are preferably made by hot blending and mixing of the ingredients and molding or casting the. bullets. The bullets may cast directly into cartridge nose-parts, which nose-parts may be separate from the bodies of the cartridges and, after casting of the bullets are attached to cartridge bodies, and preferably remain attached to the cartridge bodies during firing of the bullets; or the nose parts may be integral with the cartridge bodies.

The invention includes a method of making a bullet, for a round of ammunition comprising a hollow nose-part of a cartridge containing a propellant or chargeable with a propellant; the method including the steps of:

(a) dispersing a metallic powder in a liquid or semi-liquid settable wax-based material to form a moldable or castable composition, (b) inserting an ejectable barrier into the hollow nose-part to leave a cavity having an open front end, (c) filling said cavity with said composition and allowing or causing said composition to set to form a bullet in situ in the nose-part.

The invention includes a bullet and nose-part device made by said method; and includes a device or cartridge comprising the bullet and a hollow nose-part, which nose-part substantially contains the bullet and is integral with or is releasably securable to a cartridge body.

The method may include the further step of coating the exposed front surface of the bullet with a wax-based material.

The invention also provides a further method of making bullets, for insertion into cartridges or into a weapon, comprising the steps of:

(a) dispersing a metallic powder in a liquid or semi-liquid settable wax-based material to form a moldable or castable composition, (b) pouring or injecting composition into molds, causing said composition to set and removing the set molded or cast bullets from the molds, (c) chilling the bullets; and (d) dipping the chilled bullets into a molten wax-based material to at least partially coat the bullets, with a coating which, upon solidification, is harder than the material in the set composition.

The invention includes a bullet made by said further method.

BRIEF DESCRIPTION OF THE DRAWINGS

The invention will be described further, by way of example, with reference to the accompanying diagrammatic drawings wherein.

DETAILED DESCRIPTION OF THE INVENTION

Figure 1:
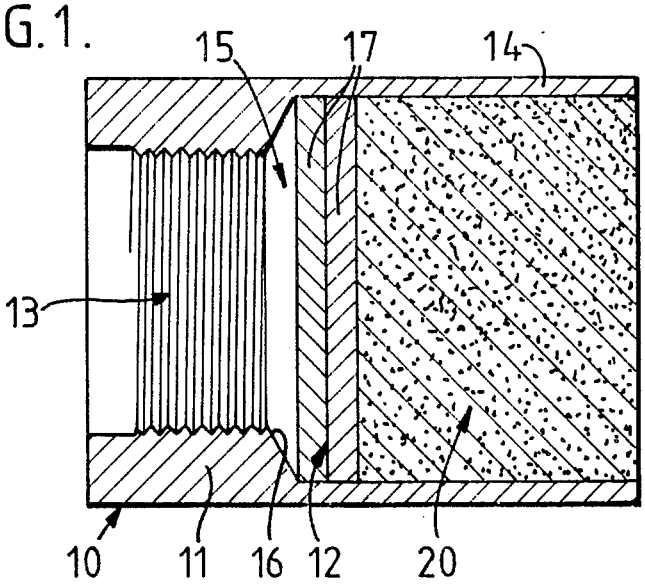
FIG. 1 shows a bullet and nosepiece device of the invention in cross-section.

The device 10 shown in FIG. 1 comprises a hollow plastics nose-part 11, a barrier 12 and a bullet 20.

The nose-part 11 has a rear portion 12 which provides a socket 13 to receive a front part of a body of a cartridge (not shown), which cartridge may be of any suitable form and may be charged or chargeable with any suitable solid, liquid or compressed gas propellant. A front portion 14 of the nose-part 11 provides a forwardly open cavity, in which the bullet 20 is displaced, which cavity is of greater diameter than the socket 13 and is connected thereto by a stepped internal opening 15 partially defined by a shoulder 16 provided in the nose-part 11.

The barrier 12 comprises two thin card or plastics discs 17, the rearmost of which abuts the shoulder 16, to provide a bottom for the cavity and a backing for the bullet 20.

The cavity, with the discs 17, in situ, serves as a mold to receive an amount of a composition which constitutes the bullet.

An example of a particularly useful composition comprises a wax matrix with a dense filler. The matrix comprises about 40 to 50%, e.g. 45% paraffin wax most of the remainder being white mineral oil. The filler comprises fine brass powder of about 90 to 110 microns maximum particle size with a very small percentage of a pigment or pigments. In a specific embodiment, the brass powder is with up to 10% pigment. The composition comprises about 20 to 25%, e.g. 22.5% matrix with the remainder being the filler. All proportions are by weight.

During manufacture, the wax is melted and blended warm with the oil to form a liquid matrix blend, the powder filler is admixed thoroughly with the molten matrix to obtain a fluent or moldable substantially liquid or semi-liquid composition which is inserted into the molds, and the filled molds are allowed to cool so that the composition sets to form the bullets.

Figure 2:
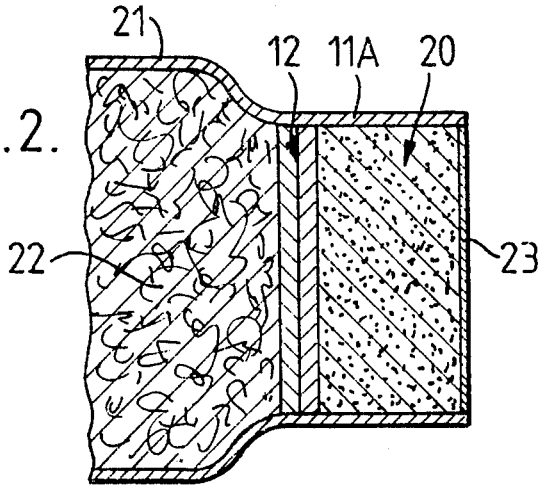
FIG. 2 shows part of a cartridge with a bullet of the invention.

Instead of being cast into nose-parts separate from the cartridge bodies, the bullets may be cast directly into nose-parts 11A integral with the cartridge bodies 21. As shown in FIG. 2, the cartridge body 21 may contain a low density wad 22 of fiber or sponge to support the barrier 12 in the bottom of the nose-part 11A to form a forwardly open mold in which the bullet 20 is cast.

In both examples, the exposed front surface of the bullet 20 may have a coating 23 about 0.1 mm thick of harder protective wax material applied thereto. The coating may comprise paraffin wax with up to 25% white mineral oil, preferably with some pigment or die for identification and marking.

In these examples, the bullet weighs about 1.7 grams, has a diameter of about 8 mm, and has a length approximately similar to its diameter.

The proportion of the matrix may be increased substantially, especially for larger bullets, but the proportion of wax may have to be decreased for bullets for arctic use or increased for tropical use. Some examples are as follows: (in which the first figure is for uncoated bullets and the figures in brackets are for bullets with the coating 23).

| Ingredient | Artic | Temperate | Tropical |
|---|---|---|---|
| Wax | 15% (10) | 25% (15–20) | 30% (20) |
| Oil | 35% (30) | 20% (20–15) | 10% (15–10) |
| Metal Powder | 45% (55) | 50% (60–65) | 55% (60–65) |
| Coloring | 5% (5) | 5% (5) | 5% (5) |

However, the proportion of the powder filler will vary according to the metal or metals employed, and proportions of at least 60%, and where possible 70%, are preferred.

The proportion of pigment may be varied and a dye may be included, or used instead of the pigment, as the coloring.

Figure 3:
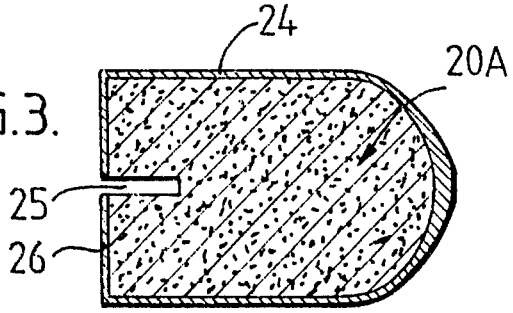
FIG. 3 shows a further bullet of the invention.

Instead of being cast into parts of cartridges, the bullets may be individually formed for subsequent fitting into a bullet feed mechanism in a gun. Such individually formed bullets 20A are preferably substantially wholly coated, as shown in FIG. 3, with a hard wax-based coating 24 about 0.5 to 0.2 mm thick. The composition of the bullets 20A may be the same as is previously described with some possible increase of the powder content and an increase in the proportion of oil to wax in the matrix. Alternatively, a wax or equivalent waxy material softer than paraffin wax may be employed in the matrix.

Such bullets are formed by casting or injection molding the composition into molds; cooling to cause the composition to solidify; extracting the bullets from the molds by means of supports which penetrate grip the rear ends of the bullets; chilling the bullets and dipping them, while chilled, into molten covering material; and separating the coated bullets from the supports. The supports may thus leave an indentation 25 in the rear of the bullets. Such indentations 25 may be situated to facilitate the rear ends 26 of the bullets being compressed as they are fitted into cartridges thereby reducing the thrust required to insert the bullets into the cartridges and thus the risk of the bullets being distorted.

The bullet may serve as a vehicle for special purpose chemicals admixed with or filler or blended with or dissolved in the matrix, e.g. reagent chemicals.

It will be readily appreciated that the bullets are not jacketed or otherwise provided with a shell or casing which could injure a person, and that the bullets are substantially wholly composed of a composition comprising a plasticized solid wax-like matrix material (or materials to provide variation in hardness at the surfaces of the bullets) which material serves as a frangible binder for dense metal particles in a filler powder.

I claim:

1. A bullet comprising:

(a) at least 60% by weight of metal particles having an average particle size less than 200 microns embedded in a soft matrix of a wax material softened by a blended-in plasticizing oil to impart softness to the bullet, and (b) the bullet being at least partially coated with a blend of wax material with a lesser proportion of oil plasticizer than the matrix was material.

2. A bullet as in claim 1 wherein the matrix comprises about 40 to 50% paraffin wax with most of the remainder being white mineral oil, the filler comprises fine brass powder of about 90 to 100 microns particle size with up to 10% of pigment, and the matrix constitutes about 20 to 25% by weight of the bullet with the remainder being the filler powder.

3. A bullet designed to disrupt upon impact and comprising:

(a) a filler powder embedded in a wax-based matrix, (b) said powder including metal particles, (c) the matrix including about 40 to 50% paraffin wax with most of the remainder being white mineral oil, (d) the filler metal particles including fine brass powder of about 90 to 110 microns maximum particle size with up to 10% of pigment, and (e) the matrix comprises about 20 to 25% by weight of the bullet with the remainder being the filler.

4. A soft marking bullet for use in operations in which the targets are persons to be marked with minimal harm, said bullet comprising:

(a) a filler powder embedded in a wax-based matrix, (b) the powder providing at least 60% of the mass of the bullet and comprising metal particles which are less than 400 microns and have an average particle size of less than 200 microns, (c) the matrix is a blend of a solid wax material and an oily plasticizer for softening the matrix in which the proportion by weight of wax material to oily plasticizer is within the range of 1:3 minimum for arctic climates to 3:1 maximum for tropical climates, (d) said matrix being sufficiently soft to cause the bullet to disrupt upon impact and/or upon being exposed to excessive propulsive forces.

5. A bullet as defined in claim 4 wherein the matrix comprises about 40 to 50% paraffin wax with most of the remainder being white mineral oil, the filler comprises fine brass powder of about 90 to 110 microns maximum particle size with up to 10% of pigment, and the matrix constitutes about 20 to 25% by weight of the bullet with the remainder being the filler powder.

6. A bullet as defined in claim 5 wherein a front surface of the bullet has a coating of a solid wax-based material having a harder consistency than the matrix.

7. A bullet as defined in claim 4 wherein at least part of the bullet has a coating less than 1 mm thick of a solid wax-based material having a harder consistency than the matrix.

8. A cartridge comprising:

(a) a nose part and a soft marking bullet for use in operations in which the targets are persons to be marked with minimal harm, (b) said bullet comprising a filler powder embedded in a wax-based matrix, (c) the powder providing at least 60% of the mass of the bullet and comprising metal particles which are less than 400 microns and have an average particle size of less than 200 microns, (d) the matrix is a blend of a solid wax material and an oily plasticizer for softening the matrix in which the proportion by weight of wax material to oily plasticizer is within the range of 1:3 minimum for arctic climates to 3:1 maximum for tropical climates, (e) said matrix being sufficiently soft to cause the bullet to disrupt upon impact and/or upon being exposed to excessive propulsive forces.

9. A cartridge as defined in claim 8 wherein the cartridge is effective to impart to the bullet less than 3.5 foot pounds of energy, the bullet having a weight of less than 3 gms, and the front surface of the bullet has a coating of a solid wax-based material having a harder consistency than the matrix.

10. A cartridge as defined in claim 8 wherein the matrix comprises about 40 to 50% paraffin wax with most of the remainder being white mineral oil, the filler comprises fine brass powder of about 90 to 110 microns particle size with up to 10% of pigment, and the matrix constitutes about 20 to 25% by weight of the bullet with the remainder being the filler powder.

* * * * *